United States Patent [19]

Dobersch

[11] 4,401,186

[45] Aug. 30, 1983

[54] SIDE PROTECTION DEVICE FOR SCAFFOLDINGS

[76] Inventor: Gerhard Dobersch, No. 10, Adolf-Kaschny-Strasse, 5090 Leverkusen, Fed. Rep. of Germany

[21] Appl. No.: 340,927

[22] Filed: Jan. 20, 1982

[30] Foreign Application Priority Data

Jan. 31, 1981 [DE] Fed. Rep. of Germany ..... 3103339

[51] Int. Cl.[3] ..... E04G 1/26

[52] U.S. Cl. ..... 182/113; 182/179; 256/23

[58] Field of Search ..... 182/113, 178, 179; 256/23, 45

[56] References Cited

U.S. PATENT DOCUMENTS

| | | | |
|---|---|---|---|
| 1,244,670 | 10/1917 | Whitney | 182/113 |
| 2,957,540 | 10/1960 | Brown | 182/113 |
| 3,382,949 | 5/1968 | Bloch | 182/113 |
| 3,752,262 | 8/1973 | Helms | 182/113 |
| 4,273,463 | 6/1981 | Dobersch | 182/179 |

FOREIGN PATENT DOCUMENTS

| | | | |
|---|---|---|---|
| 1306476 | 9/1962 | France | 182/113 |
| 1479521 | 3/1967 | France | 182/113 |

*Primary Examiner*—R. P. Machado
*Attorney, Agent, or Firm*—John C. Smith, Jr.

[57] ABSTRACT

A side protection device for scaffoldings, particularly metal scaffoldings including a plurality of substantially vertical tubular posts, each having at least one bracket thereon, traverses attached to the posts, and a boarding resting on the traverses is provided. The side protection device comprises a collapsible framework which is composed of at least one horizontal tubular brace and two substantially vertical tubular side members affixed to the ends of the horizontal tubular brace. The framework can be suspended by means of two supporting arms on two brackets occupying a fixed position on the tubular posts of the scaffolding so that it extends downwards as far or almost as far as the boarding of the scaffolding. The ends of the supporting arms pass, with a certain amount of clearance, through two elongated mounting devices situated on the vertical tubular side members of the framework of the side protection device, in such a way that the side protection device, after being mounted onto the tubular post, will be vertically displaceable by the supporting arms and vertically pivotable, about the supporting arms, towards the relevant section of the scaffolding.

1 Claim, 3 Drawing Figures

II

SIDE PROTECTION DEVICE FOR SCAFFOLDINGS

BACKGROUND OF THE INVENTION

This invention relates to a side protection device for scaffoldings, particularly tubular metal scaffoldings, which consists of a framework which is formed by at least one horizontal latch or brace and two substantially vertical side members affixed to the ends of the brace and which can be suspended by means of two supporting arms on brackets occupying a fixed position on substantially vertical tubular posts of the scaffolding and which after being suspended thereon extends downwards as far or almost as far as the boarding of the scaffolding.

Side protection devices of this kind are already known from German Utility Model 69 23 792. They can be provided, for example, with a lattice structure occupying a fixed position between their side members and filling the space between the latter or else with struts which support the posts mutually. The known side protection devices nevertheless suffer from major drawbacks which reside in the following factors: The present safety regulations require a side protection device to extend to at least a certain specified height above the boarding of a scaffolding. This minimum height, however, cannot be reached by the known types of side protection in cases in which the boardings of the separate sections of the scaffolding are situated at different heights from one another where overlaps occur. It is true that the side protection device could be dimensioned in the vertical direction in such a manner as to ensure that it reaches the prescribed height in every case. This, however, would have disadvantageous effects, particularly on the weight of the protection device. Furthermore, the known type of protection device cannot be pivoted upwards when the scaffolding is being supplied with material. There has admittedly a vertically pivotable side protection device become known from German Published Application 26 58 583 which is adjustable to the height required in each particular case. For this purpose the side members of the side protection device have two holders opposite each other, provided with a swivel joint and constructed as clamps by the aid of which the side protection device can be affixed to two tubular posts. Each side member, moreover, has two holders constructed as clamps and enabling the side protection device to be locked in the selected position with the two tubular posts. Side protection devices of this kind, however, suffer from the drawback that they have to be rigidly secured to these latter in order to prevent them from being accidentally pivoted out of position. The operations of mounting and dismantling this known side protection device are therefore relatively time consuming, apart from the fact that it first has to be released before each pivoting operation.

SUMMARY OF THE INVENTION

It is the object of the present invention to provide a side protection device of the type described at the beginning which is constructed in such a manner that after being suspended onto the brackets of the tubular posts of a scaffolding it will assume the prescribed minimum height from the boarding, on which it will rest by its lower end, even if the boarding is situated at different heights in the individual sections of the scaffolding, the side protection device being vertically pivotable without first having to be partly detached from the tubular posts.

To attain this object the present invention provides a side protection device for scaffoldings, particularly tubular metal scaffoldings including a plurality of substantially vertical tubular posts, each having at least one bracket thereon, tranverses attached to the posts, and a boarding resting on the traverses, said side protection device comprising a collapsible framework which is composed of at least one horizontal tubular brace and two substantially vertical tubular side members affixed to the ends of the horizontal tubular brace and which can be suspended by means of two supporting arms on two brackets occupying a fixed position on the tubular posts of the scaffolding and which after being suspended thereon extends downwards as far or almost as far as the boarding of the scaffolding, characterized by the fact that the ends of the supporting arms pass, with a certain amount of clearance, through two elongated mounting devices situated on the vertical tubular side members of the framework of the side protection device, in such a way that the said side protection device, after being mounted onto the tubular posts, will be vertically displaceable by the supporting arms and vertically pivotable, about the supporting arms, towards the relevant section of the scaffolding.

The side protection device suspended on the brackets of the tubular posts automatically comes to rest by force of gravity on the boarding of the scaffolding, thus inevitably assuming the prescribed minimum height, regardless of whether it rests on the boarding of the scaffolding itself or on a second boarding overlapping the first. This enables the height adopted in the design of the side protection device to be reduced to a minimum. The side protection device can be pivoted about the supporting arms without first having to be partly detached from the tubular posts, as has been necessary hitherto. Finally, it can be attached to the posts in an extremely simple manner, since for this purpose they merely have to be suspended by their supporting arms on the brackets provided on the posts.

BRIEF DESCRIPTION OF THE DRAWING

An embodiment of the invention will now be described by way of example and with reference to the accompanying drawing in which.

DESCRIPTION OF THE PREFERRED EMBODIMENT

Figures 1, 2, 3:
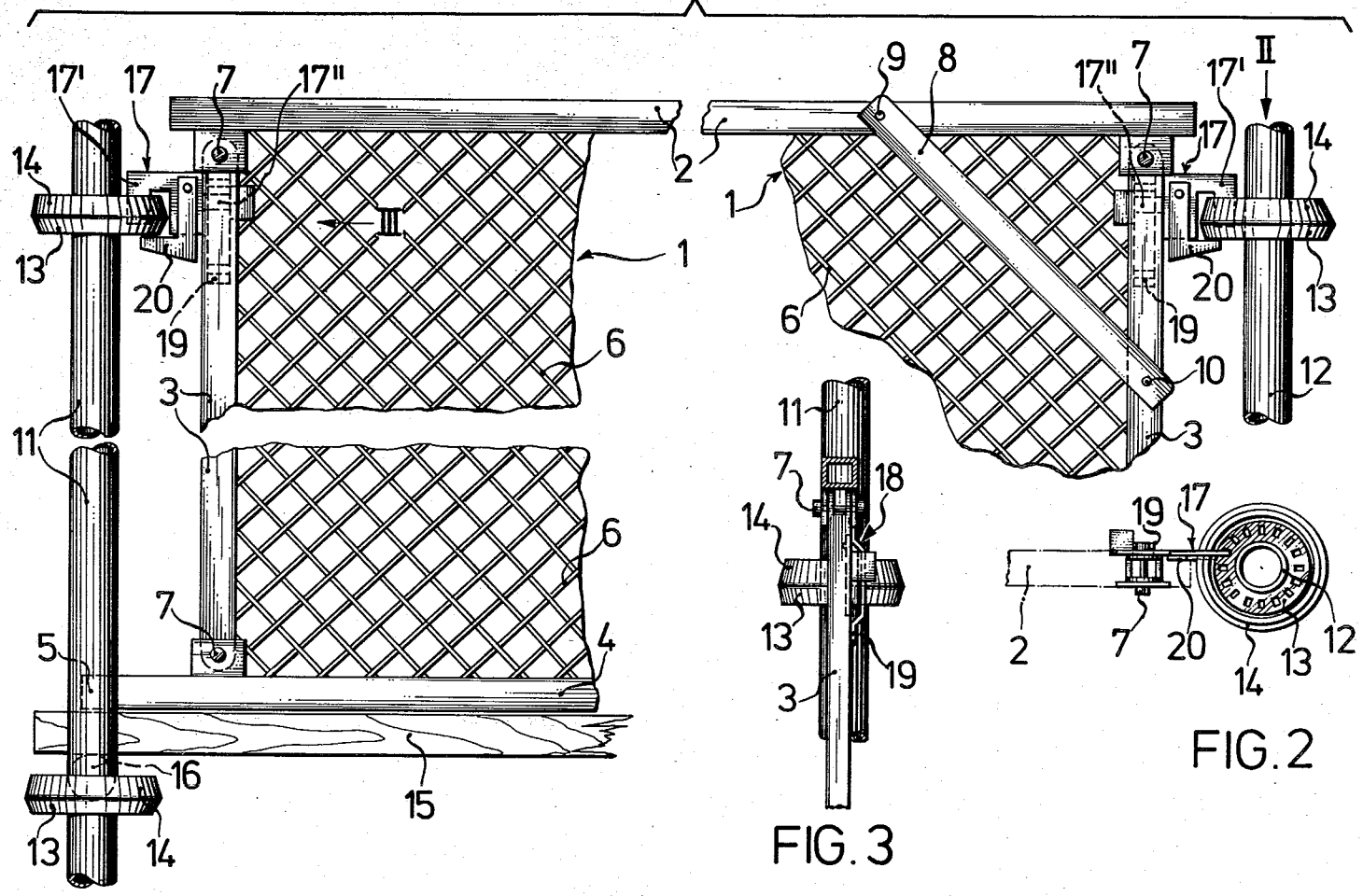
FIG. 1 is an elevation of part of a side protection device according to the invention.
FIG. 2 is a plan view of part of the side protection device seen in the direction of the arrow II of FIG. 1.
FIG. 3 is a side view of another part of the side protection device seen in the direction of the arrow III of FIG. 1.

FIG. 1 shows a side protection device for scaffoldings which consists of a collapsible framework 1, which is made up of an upper horizontal tubular brace 2, two substantially vertical tubular side members 3 affixed to the ends of the horizontal brace 2 and also a lower horizontal tubular brace 4 rigidly interconnecting the lower ends of the vertical posts 3. The ends 5 of the lower horizontal brace 4 project beyond the side members 3. The framework 1 is lined with a lattice structure 6 made of a flexible material. The side members 3 are articulated to the horizontal braces 2 and 4 via pivots 7 in such a way that the side protection device is collapsible when not in use so that it will then only occupy a minimum amount of space. An arm 8 has one of its ends articulated at 9 to the upper horizontal brace 2, while the other end is detachably affixed at 10 to one of the two side members 3. The arm 8 serves to stabilize the side protection device when it is in erected position. The reference numerals 11 and 12 designate two substantially vertical tubular posts of a scaffolding, which are situated at a certain distance apart, while holding means in the form of brackets 13, encompassing the tubular posts 11 and 12 in the manner of flanges, are affixed at a certain vertical distance apart to the posts. Each of the brackets 13 has an upstanding circular collar 14 which provides an annular space between itself and the upper surface of the bracket, on the one side, and the post 11 or 12, on the other side. A boarding 15 rests on traverses 16 of the scaffolding.

The side members 3 of the side protection device are provided with two supporting arms 17 each of which has one end forming a jaw 17' and another end forming a spigot 17''. The spigots 17'' on the supporting arms 17 pass, with a certain amount of clearance, through elongated mounting devices 18 (FIG. 3) which are situated in the vicinity of the upper ends of the side members 3 and in which they are displaceable in the vertical direction. Each mounting device 18 is formed by a strap 19 affixed to its side member 3 and by the outer surface of the said side member 3. The jaws 17' of the supporting arms 17 are firmly mounted on the collars 14 of the brackets 13.

The spigots 17'' include a widened portion which prevents them from being accidentally detached from the elongated mounting devices 18. Two two-armed bolts 20 are each articulated by one arm to the sides of the jaws 17' of the supporting arms 17, the other arm of each bolt passing under the bracket 13. The side protection device rests on the boarding 15, resting by the ends 5 of its lower horizontal brace 4 against the posts 11 and 12 within the relevant section of the scaffolding, so that the side supporting device is only pivotable towards the said section.

The invention may be embodied in other specific forms without departing from the spirit or essential characteristics thereof. The embodiment is therefore to be considered in all respects as illustrative and not restrictive.

What is claimed is:

1. A side protection device for scaffoldings, particularly metal scaffoldings including a plurality of substantially vertical tubular posts, each having at least one bracket thereon, traverses attached to the posts, and a boarding resting on the traverses, said side protection device comprising a collapsible framework which is composed of at least one horizontal tubular brace and two substantially vertical tubular side members affixed to the ends of the horizontal tubular brace and which can be suspended by means of two supporting arms on two brackets occupying a fixed position on the tubular posts of the scaffolding and which after being suspended thereon extends downwards as far or almost as far as the boarding of the scaffolding, characterized by the fact that the ends of the supporting arms (17) pass, with a certain amount of clearance, through two elongated mounting devices (18) situated on the vertical tubular side members (3) of the frame work of the side protection device, in such a way that the said side protection device, after being mounted onto the tubular posts (11, 12), will be vertically displaceable by the supporting arms and vertically pivotable, about the supporting arms, towards the relevant section of the scaffolding.

* * * * *